US012410809B2

(12) United States Patent
Wrighton et al.

(10) Patent No.: US 12,410,809 B2
(45) Date of Patent: Sep. 9, 2025

(54) BREATHER TUBE FOR LABYRINTH SEAL CHAMBER

(71) Applicant: Saudi Arabian Oil Company, Dhahran (SA)

(72) Inventors: Christopher Wrighton, Aberdeenshire (GB); Sakethraman Mahalingam, Aberdeenshire (GB)

(73) Assignee: Saudi Arabian Oil Company, Dhahran (SA)

( * ) Notice: Subject to any disclaimer, the term of this patent is extended or adjusted under 35 U.S.C. 154(b) by 212 days.

(21) Appl. No.: 18/203,391

(22) Filed: May 30, 2023

(65) Prior Publication Data

US 2024/0401602 A1 Dec. 5, 2024

(51) Int. Cl.

| | |
|---|---|
| ***F04D 29/10*** | (2006.01) |
| ***E21B 43/12*** | (2006.01) |
| ***F04B 7/02*** | (2006.01) |
| ***F04B 7/06*** | (2006.01) |

(52) U.S. Cl.

CPC ..... *F04D 29/106* (2013.01); *E21B 43/128* (2013.01); *F04B 7/02* (2013.01); *F04B 7/06* (2013.01)

(58) Field of Classification Search

CPC ..... E21B 43/128; F04B 47/06; F04B 47/02

See application file for complete search history.

(56) References Cited

U.S. PATENT DOCUMENTS

| | | | | | |
|---|---|---|---|---|---|
| 1,329,559 | A * | 2/1920 | Tesla | F15D 1/02 | 137/842 |
| 3,182,214 | A * | 5/1965 | Boyd | F04D 29/128 | 277/408 |
| 4,421,999 | A * | 12/1983 | Beavers | F04D 13/10 | 310/87 |
| 4,667,737 | A * | 5/1987 | Shaw | F16J 15/004 | 166/104 |
| 4,992,689 | A | 2/1991 | Bookout | | |
| 5,203,080 | A * | 4/1993 | Bookout | H02K 5/132 | 29/890.09 |
| 5,367,214 | A | 11/1994 | Turner, Jr. | | |
| 6,307,290 | B1 * | 10/2001 | Scarsdale | H02K 5/132 | 310/87 |
| 6,412,562 | B1 * | 7/2002 | Shaw | F04D 13/086 | 166/105 |
| 6,602,059 | B1 * | 8/2003 | Howell | F04B 47/06 | 417/424.2 |
| 6,666,664 | B2 * | 12/2003 | Gross | F04D 13/10 | 417/424.2 |

(Continued)

*Primary Examiner* — Christopher S Bobish

(74) *Attorney, Agent, or Firm* — Bracewell LLP; Constance G. Rhebergen; Keith R. Derrington

(57) ABSTRACT

An electrical submersible pumping assembly includes a motor, a pump connected to the motor by a shaft, and a labyrinth type seal section between the motor and pump. Hydrostatic pressure is communicated between the motor and pump across the seal section and through a breather tube in the seal section that is configured to restrict fluid communication from the pump to the motor. A U-shaped bend is provided in the breather tube to increase its effective length. Optionally, a number of recycle loops are formed on the breather tube similar to a Tesla valve. In an alternative, the shaft includes a helical flight that directs fluid to a mechanical shaft seal between pump and seal section.

18 Claims, 6 Drawing Sheets

(56) References Cited

U.S. PATENT DOCUMENTS

| | | | | |
|---|---|---|---|---|
| 7,066,248 | B2 * | 6/2006 | Howell | F04D 13/12 166/66.4 |
| 7,367,400 | B1 * | 5/2008 | Howell | H02K 5/132 166/66.4 |
| 8,419,387 | B1 * | 4/2013 | Karbs | F04B 53/02 417/414 |
| 9,249,649 | B2 * | 2/2016 | Fripp | E21B 34/08 |
| 9,303,648 | B2 | 4/2016 | Mack | |
| 9,695,654 | B2 * | 7/2017 | Stephenson | E21B 21/01 |
| 10,299,636 | B2 * | 5/2019 | Ophardt | B01F 25/432 |
| 10,302,089 | B2 * | 5/2019 | Meyer | F04D 13/08 |
| 10,371,167 | B2 * | 8/2019 | Meyer | F04D 13/10 |
| 10,519,756 | B2 * | 12/2019 | Crane | E21B 41/0085 |
| 10,822,933 | B2 * | 11/2020 | Crane | F04D 29/586 |
| 10,928,841 | B2 * | 2/2021 | Tanner | E21B 43/128 |
| 11,365,809 | B2 * | 6/2022 | Collins | F04D 29/106 |
| 11,493,048 | B2 * | 11/2022 | MacIver | F04D 13/086 |
| 12,196,209 | B2 * | 1/2025 | Koester | F04C 23/008 |
| 2007/0207046 | A1 * | 9/2007 | Du | E21B 43/128 310/87 |
| 2011/0236233 | A1 * | 9/2011 | Merill | F04B 17/03 417/410.1 |
| 2014/0069629 | A1 * | 3/2014 | McCann | E21B 43/128 166/66.4 |
| 2016/0076550 | A1 * | 3/2016 | Collins | F16J 15/002 277/336 |
| 2017/0037861 | A1 * | 2/2017 | Rutter | F04D 29/102 |
| 2018/0313359 | A1 * | 11/2018 | Meyer | E21B 43/128 |
| 2019/0003476 | A1 * | 1/2019 | Jee | F04B 53/18 |
| 2020/0072357 | A1 * | 3/2020 | MacIver | E21B 43/128 |
| 2023/0174870 | A1 * | 6/2023 | Presley | C10G 1/10 585/241 |
| 2024/0102355 | A1 * | 3/2024 | Dorban | E21B 43/12 |
| 2024/0337169 | A1 * | 10/2024 | Romer | E21B 33/1208 |

* cited by examiner

BREATHER TUBE FOR LABYRINTH SEAL CHAMBER

BACKGROUND OF THE INVENTION

1. Field of Invention

The present disclosure relates to an electrical submersible pump system ("ESP"), and more particularly to an ESP having a labyrinth seal section with a breather tube that substantially limits flow to a single direction.

2. Description of Prior Art

Artificial lift is generally employed in hydrocarbon producing wells that lack adequate pressure to lift liquid from inside the well. One type of artificial lift is an electrical submersible pump ("ESP") that includes an electrically powered motor filled with a dielectric fluid. A drive shaft connects the motor to a pump, energizing the motor rotates the shaft that rotates impellers in the pump. The pump is often a centrifugal pump with multiple stages of impellers and diffusers for pressurizing the liquid. Typically, a seal section is included between the motor and the pump for equalizing pressure of the dielectric fluid inside the motor with hydrostatic pressure in the well. If well fluids are allowed to enter the motor an electrical short can occur and damage the motor.

Seal sections are typically designed to communicate hydrostatic pressure to dielectric fluid in the motor without allowing wellbore fluid to enter the motor. The seal sections usually include either a flexible diaphragm, a bellows, or a labyrinth chamber. In diaphragms and bellows the physical barriers between the wellbore fluid and dielectric fluid are elastomer or metal membranes, and in labyrinth chambers the physical barrier is an elongated flow circuit filled with dielectric fluid Wellbore fluid can still migrate to the motor if the labyrinth chamber is an inadequate obstacle, or failure of seals on the drive shaft within the seal section.

SUMMARY OF THE INVENTION

Disclosed herein is an example of an electrical submersible pumping system ("ESP") that includes a motor, a shaft having an end attached to the motor, a pump attached to an end of the shaft distal from the motor, and a seal section disposed between the motor and the pump. In this example the seal section includes a breather tube having, an uphole end that is in pressure communication to ambient hydrostatic pressure, a downhole end distal from the uphole end and that is in pressure communication with the motor, and a mid-portion having an undulating contour. Examples of the undulating contour include a U-shaped bend. In an alternative, the undulating contour is a recycle loop mounted to the breather tube, the recycle loop having a curved mid-section and upper and lower ends that intersect the breather tube at spaced apart locations along a length of the breather tube to define a valvular conduit. Optionally, the upper end intersects the breather tube at an upper intersection that is uphole of where the lower end intersects the breather tube, where the portion of the recycle loop proximate to the upper intersection is at an acute angle to a portion of the breather tube adjacent the upper intersection and on a side opposite the uphole end, and where the portion of the recycle loop proximate to the lower intersection is at an acute angle to a portion of the breather tube adjacent the lower intersection and on a side opposite the uphole end. In another example, the ESP further includes a multiplicity of recycle loops arranged in series along the length of the breather tube. The ESP optionally includes a seal section housing, a guide tube in the seal section that circumscribes a portion of the shaft and that is spaced radially inward from the seal section housing, and a labyrinth chamber defined in annulus between the guide tube and seal section housing. In this example the breather tube is disposed in the labyrinth chamber and a port is optionally formed radially through the guide tube at a location axially between the uphole and downhole ends of the breather tube, so that a pressure communication path between the pump and the motor extends from the uphole end of the breather tube to the downhole end of the breather tube, uphole to the port, and downhole to the motor in an annular space between the shaft and the guide tube. In another example the ESP includes a mechanical seal on the shaft and a helical flight on the downhole of the mechanical seal, the flight configured to increase fluid pressure on a downhole side of the mechanical seal. Alternatives of undulating contour include a diameter of the breather tube that increases with distance from uphole end to the downhole end.

Another example of an electrical submersible pumping system ("ESP") is disclosed and that includes a motor, a pump uphole of the motor, a shaft having an end attached the motor and an opposing end attached to the pump, and a seal section disposed between the motor and the pump having a labyrinth chamber with a flow path that restricts fluid communication. The ESP of this example further optionally includes a helical flight on an outer surface of the shaft that operates as a positive displacement pump with rotation of the shaft and so that fluid exiting the positive displacement pump generates an increase in pressure on a downhole side of a mechanical seal around the shaft. In an example the seal section includes an outer housing with a seal head on an uphole end of the housing, the seal head having an axial bore that receives the shaft, and wherein a vent tube is formed through the seal head that provides a flow path for fluid to flow into the seal section from adjacent the mechanical seal. In alternatives the flow path extends through a breather tube with a U-shaped portion, a breather tube with a diameter that increases with distance downhole, or a valvular conduit. In one example, fluid flow in a direction to the motor is restricted in the valvular conduit, and wherein fluid flow in a direction away from the motor flows substantially unimpeded through the valvular conduit.

BRIEF DESCRIPTION OF DRAWINGS

Some of the features and benefits of the present invention having been stated, others will become apparent as the description proceeds when taken in conjunction with the accompanying drawings, in which.

Figure 1:
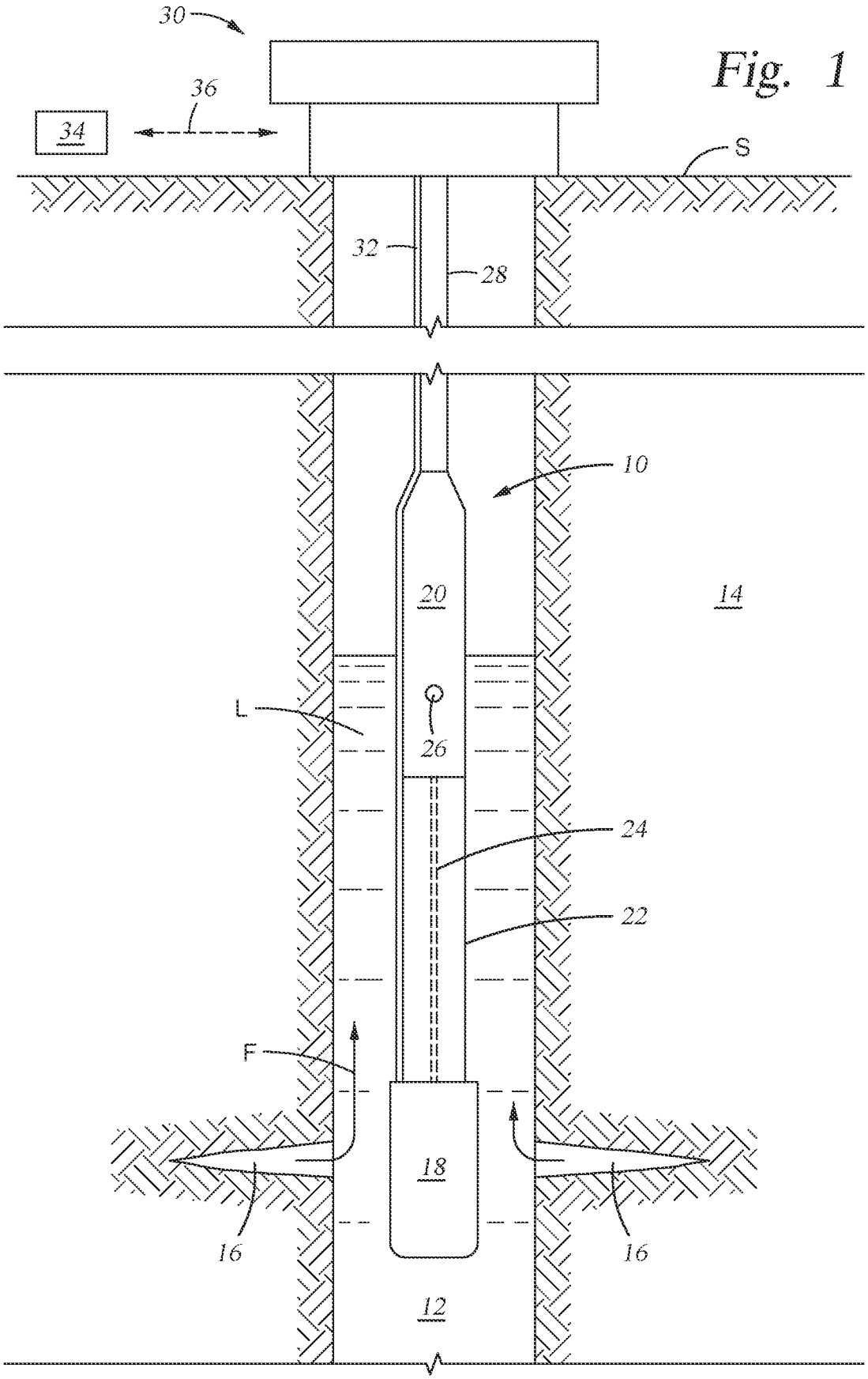
FIG. 1 is a side sectional view of an example of an Electrical Submersible Pumping Assembly ("ESP") disposed in a wellbore.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Show in a side partial sectional view in FIG. 1 is an example of an electrical submersible pumping system ("ESP") 10 disposed in a well or 12 and which is used to artificially lift fluid F produced from surrounding formation 14. In the example shown, perforations 16 are formed radially outward into formation 14 to allow a flow path for fluid F to make its way to wellbore 12. ESP 10 includes a motor 18 on its lower or downhole portion. A pump 20 is on an upper end of ESP 10 located uphole from motor 18. A seal section 22 is disposed between the motor 18 and pump 20. Shown in dashed outline is a shaft 24 that extends from motor 18 to pump 20 and axially through the seal section 22. Fluid F includes liquid L, which is shown having accumulated to a level within wellbore 12. The level of the liquid L is above an inlet 26 to the pump 20, and when pump 20 is operating the fluid F is drawn into pump 20 via inlet 26. Inside pump 20 are impellers (not shown) that are attached to shaft 24 and rotate when shaft 24 is rotated by energizing motor 18. Rotating the impellers pressurizes fluid F drawn into pump 20. Also in pump 20 are diffusers sequentially located by impellers, the combination of which direct the fluid F along a helical path inside pump 20. Production tubing 28 is shown attached to an upper end of pump 20, and pressured fluid is discharged from pump 20 into tubing 28. Tubing 28 in shown supporting the ESP 10 within wellbore 12. An upper end of tubing 28 attaches to a wellhead assembly 30 mounted on surface S. Wellhead assembly 30 provides pressure control for well 12 and way for diverting the produced liquid to offsite facilities for further processing or storage. In the example shown, a power cable 32 extends down to motor 18 within well 12 and which conducts electricity from a power source 34 on surface S to motor 18. A communication means 36 is optionally included for conveying command signals and operational data between surface S and the ESP 10; examples of communication means 36 include wireless, hardwired, a telemetry means, and combinations.

Figure 2:
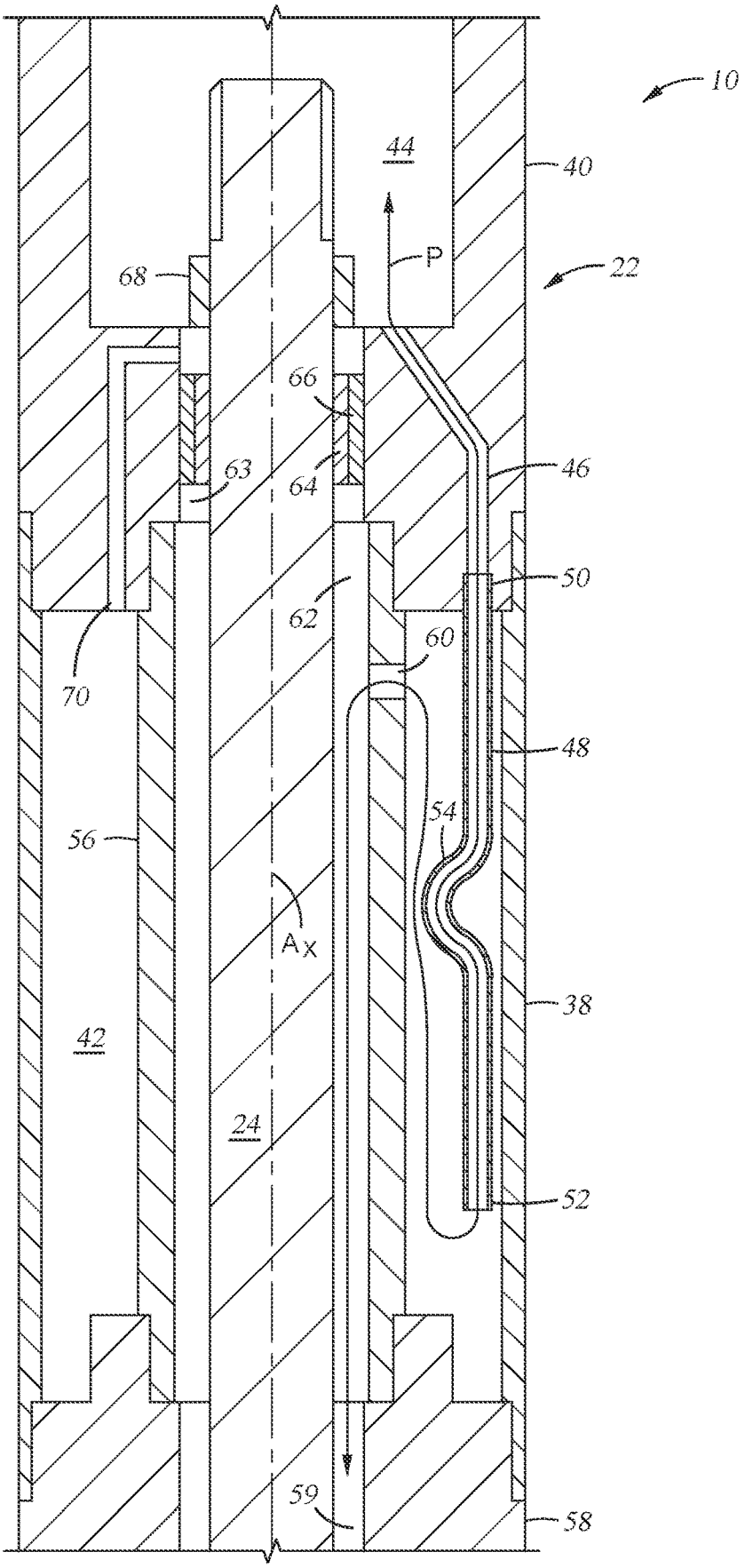
FIG. 2 is a side sectional view of an example of a portion of a seal section in the ESP of FIG. 1.

FIG. 2 is a side sectional view of a portion of seal section 22 in ESP 10. Provided in this example is that seal section 22 has an outer housing 38 that circumscribes an axis Ax of seal section 22. Mounted to an uphole end of housing 38 is a seal head 40, which is shown as a substantially solid and cylindrical member. An annular labyrinth chamber 42 is formed within housing 38 and a head chamber 44 is formed inside seal head 40. As described in more detail below, the head chamber 44 is selectively in communication with pressure and fluid ambient to the ESP 10. A passage 46 is formed through the seal head 40 and extends from a downhole end of the head chamber 44 into an uphole end of the labyrinth chamber 42. An elongated breather tube 48 is shown having an uphole end 50 attached to where passage 46 intersects labyrinth chamber 42. A downhole end 52 of breather tube 48 is in the labyrinth chamber 42 and so that chambers 42, 44 are in communication with one another via passage and breather tube 48. A mid portion of breather tube 48 is configured with a loop 54, shown as a U-shaped portion, and that increases an effective length of the breather tube 48 past its actual axial length shown within seal section 22.

Inside housing 38 is an annular guide tube 56 that extends from the downhole portion of the seal head 40 and attaches to an uphole side of a bulkhead 58, where bulkhead 58 is illustrated as a cylindrical member with an axial bore 59 and attached to a downhole end of housing 38. Guide tube 56 circumscribes shaft 24 and defines an inner radial boundary of the labyrinth chamber 42. A port 60 is formed radially through a side wall of guide tube 56 at a location axially uphole from the downhole end 52 of breather tube 48. The guide tube 56 forms a guide tube chamber 62 within and that is in pressure communication with motor 18 (FIG. 1). A bore 63 is also formed axially through seal head 40 and shaft 24 extends axially through bore 59 and bore 63. Inner and outer bearings 64, 66 are shown in between shaft 24 and bore 63. A mechanical face seal 68 is illustrated within the head chamber 44 and around shaft 24, and that defines a barrier to pressure and fluid communication through bore 63 along shaft 24. Also formed through seal head 40 is a vent blind 70 that extends axially from a downhole end of the seal head 40 and then projects radially inward to bore 63 between bearing 64, 66, and the mechanical face seal 68.

Still referring to FIG. 2, a pressure communication path P is shown that schematically depicts a route of pressure communication between ambient hydrostatic pressure and dielectric fluid inside motor 18 (FIG. 1). As noted above, chamber 44 is in communication with ambient hydrostatic pressure, path P is shown extending from chamber 44 through passage 46 and breather tube 48 into the labyrinth chamber 42, then across port 60 and into guide tube chamber 62, which communicates directly with the dielectric fluid in the motor 18. In the example shown, the spatial locations of the downhole end 52, the length of the labyrinth chamber 42, and the length between the downhole end 52 and port 60 form an elongated flow path for any well fluid that may enter into the head chamber 44 and motor 18. Moreover, the addition of the U-shaped loop 54 inside breather tube 48 further lengthens this communication path to increase effectiveness of the barrier to communicating to any damaging well fluid to the motor 18. In an alternative, breather tube 48 is configured to have a diameter that increases with distance away from the uphole end 50 which further introduces a resistance to flow of well fluid towards motor 18 and through the fluid communication path P.

Figure 2A:
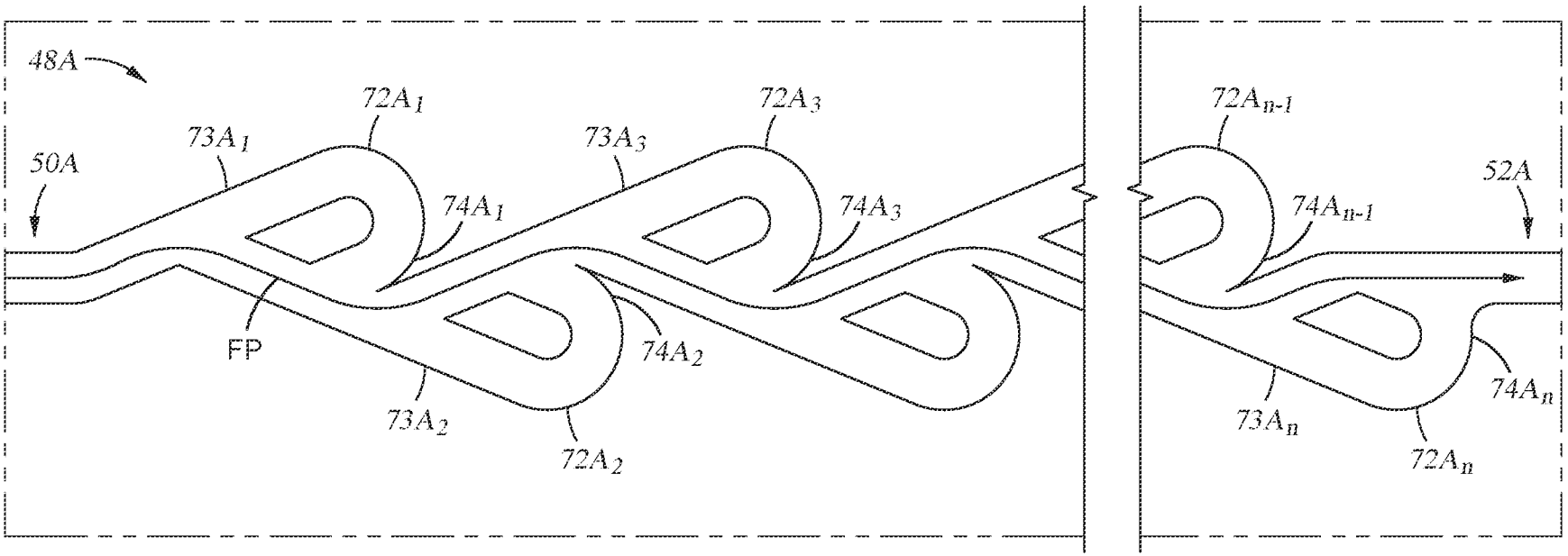
FIGS. 2A-2C are side schematic views of an embodiment of a breather tube in the seal section of FIG. 2.
Figure 2B:
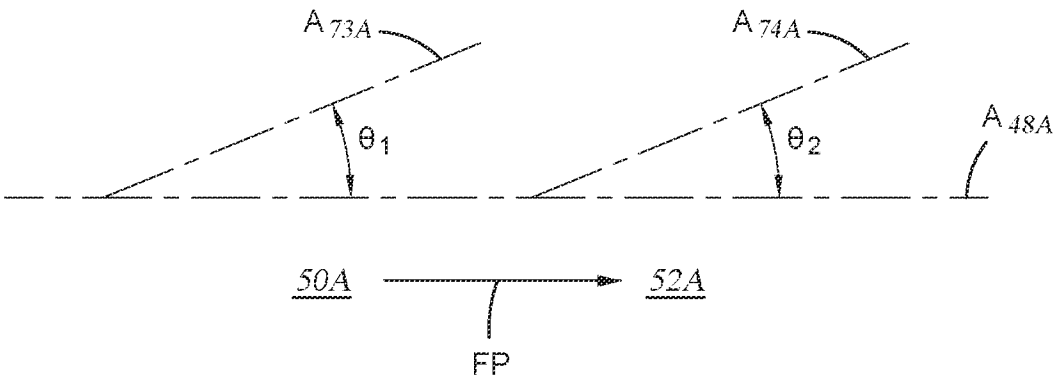
Figure 2C:
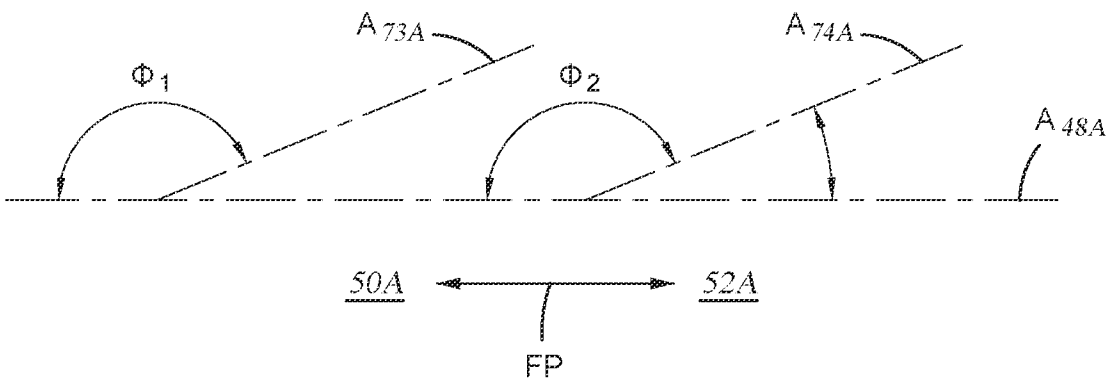

Referring out of FIGS. 2A-2C, an alternative example of the breather tube 48A is shown. In this example, the breather tube 48A is equipped with a series of flow loops $72A_{1-n}$ are arranged along the breather tube 48A and which an uphole and downhole ends $73A_{1-n}$ and $74A_{1-n}$ that intersect the breather tube 48A at axially spaced are locations. In an example, the breather tube 48A with the flow loops $72A_{1-n}$ define a valvular conduit, an example of which is shown in Tesla, U.S. Pat. No. 1,329,559, which is incorporated herein in its entirety and for all purposes. In the example FIGS. 2A-2C, the flow loops $72A_{1-n}$ are disposed generally sequential with one another along the length of the breather tube 48A, alternatives exist where there is some overlapping between these flow loops $72A_{1-n}$ or there is some axial distance between a downhole end $72A_{1-n}$ and the next sequential uphole end $73A_{1-n}$ of the adjacent flow loops $72A_{1-n}$.

Referring specifically to FIG. 2B, an example of a flow of fluid F $F_{48A}$ inside breather tube 48A is shown in a direction that is downhole, i.e., from the uphole end 50A to downhole end 52A. As shown, a main flow of fluid $F_{48A}$ flows inside the breather tube 48A which entered tube 48A from the uphole end 50A. Portions of the main flow of fluid $F_{48A}$ selectively divert into bypass $72A_1$, shown as flow of fluid $F_{72A1}$, and due to the high angle of bending within the flow loop $72A_1$, flow of fluid $F_{72A1}$ reenters tube 48A at a location downstream of where it was diverted from tube 48A and in a direction that is substantially opposite that of flow of fluid $F_{48A}$ The cumulative effect of the multiple flow loops $72A_{1-n}$ retards the flow of fluid $F_{48A}$ in this direction of from uphole end 50A to downhole end 52A. This is further schematically illustrated by the relative orientations of axis $A_{48A}$ with axes $A_{73A}$, $A_{74A}$. As shown, angles $\Phi_1$, $\Phi_2$ between axis $A_{48A}$ and axes $A_{73A}$, $A_{74A}$ are each acute angles, and in examples these angles have similar or the same magnitudes. The schematic example illustrated how the bypass loops $72A_{1-n}$ draw off a side stream of fluid at an angle that is then redirected back into the main flow at substantially the same angle and in a direction that is largely opposite. Further shown in FIG. 2B is the flow path FP which illustrates the direction of flow of fluid $F_{48A}$ from uphole end 50A to downhole end 52A.

FIG. 2C illustrates an example of a flow of fluid $F_{48A}$ through tube 48A in a direction from downhole end 52A to uphole end 50A. In this example, fluid such as dielectric fluid in motor 18 is flowing uphole and towards the seal head 40 and is in contrast to the flow in the opposite direction which could bring damaging well fluid to the motor 18. In this example, angles $\phi_1$, $\phi_2$ between axis $A_{48A}$ and the axes of uphole and downhole ends $A_{73A}$, $A_{74A}$ are both obtuse. In examples, the magnitudes of angles $\phi_1$, $\phi_2$ are similar or equal. In the example illustrated in FIG. 2C, side stream magnitudes are negligible as the geometry of the breather tube 48A discourages fluid diversion from the main flow of fluid $F_{48A}$ into the bypass loops $72A_{1-n}$. Because the obtuse angles required for the fluid to maneuver before entering the flow loops 48A creates or allows for a very small amount of side stream fluid, so that flow in the direction from the downhole end 52A to uphole end 50A is largely unimpeded along breather tube 48A.

Figure 3:
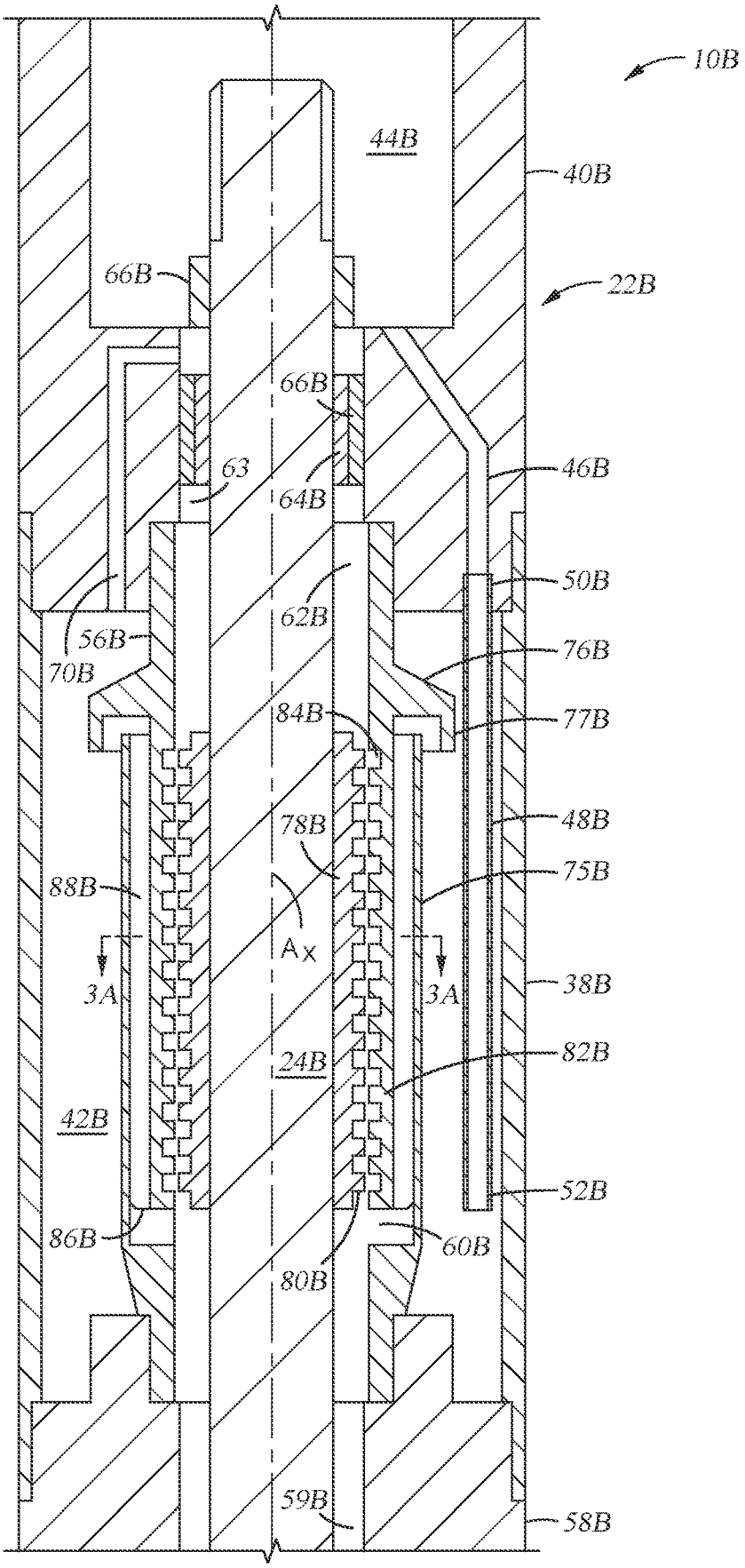
FIG. 3 is a side sectional view of an alternate example of the seal section of FIG. 2.
Figure 3A:
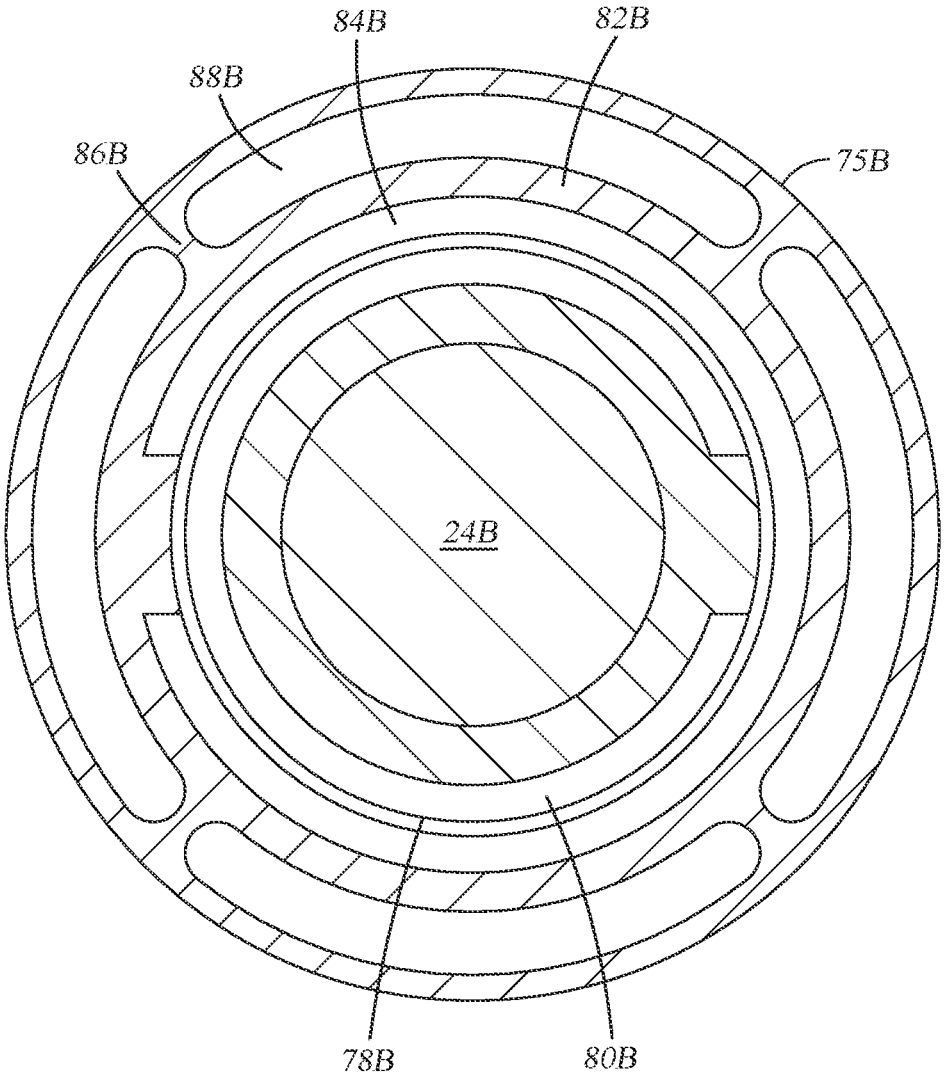
FIG. 3A is an axial view of a portion of FIG. 3 taken along lines 3A-3A.

FIG. 3 is an alternate embodiment of the portion of seal section 22B making up the ESP 10B. In this example, port 60B is formed radially through a downhole portion of guide tube 56B and inside housing 38B is an annular labyrinth wall 75B is provided that has a downhole end fixed to the downhole portion of guide tube 56B and spaced radially outward from port 60B. Labyrinth wall 75B is spaced radially outward from a mid-portion of the guide tube 56B and has an upper end that is adjacent to a shroud 76B. Shroud 76B projects radially outward from guide tube 56B and has a lip 77B on its radial tip that extends downhole past the upper end of labyrinth wall 75B. In this example, a flight member 78B is included which is a sleeve-like element that is shown circumscribing shaft 24 and mounted onto an outer surface of shaft 24B, such as with a key (not shown) for rotational coupling, and in alternatives is axially coupled with circlips or by sleeves (not shown) that extend to bearings 64B, 66B. Flight member 78B is shown in FIG. 3 extending along an axial distance largely circumscribed by the labyrinth wall 75B. Included on an outer surface of flight member 78B is a flight element 80B that projects radially outward from flight member 78B and extends along flight member 78B in a helical pattern. An optional outer flight 82B is included which is formed along an inner surface of guide tube 56B and that faces an outer surface of flight member 78B. On an inner surface of outer flight 82B is an outer flight member 84B, which extends axially along a portion of outer flight 82B and that projects radially inward towards flight element 80B; and in examples is configured complementary to flight element 80B. Webs 86B are shown in FIG. 3A extending radially between diffuser flight 82B and labyrinth wall 75B and through a flow path 88B formed between flight 82B and wall 75B. In a non-limiting example guide tube 56B (with its outer flight 82B and outer flight member 84) and labyrinth wall 75B are a single piece and held together with the webs 86A. In examples, the single piece is cast or fabricated using additive manufacturing.

In a non-limiting example of operation, flight member 78B and flight element 80B rotate with rotation of shaft 24B and generate a flow of fluid along shaft 24B in an uphole direction within the guide tube 56B. Past the bearings 64B, 66B the fluid impinges on a downhole surface of the mechanical seal 68B and generates a localized increase in pressure, which in the event of failure of mechanical seal 68B would form a barrier to a flow of well fluid along shaft 24B and to motor 18 (FIG. 1).

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. An electrical submersible pumping system ("ESP") that is selectively disposed in a wellbore, the ESP comprising:
- a motor;
- a shaft having an end attached to the motor;
- a pump attached to an end of the shaft distal from the motor; and
- a seal section disposed between the motor and the pump comprising,
  - a breather tube having,
    - an uphole end that is in pressure communication to ambient hydrostatic pressure,
    - a downhole end distal from the uphole end and that is in pressure communication with the motor, and
    - a mid-portion having an undulating contour that comprises a recycle loop mounted to the breather tube, the recycle loop having a curved mid-section and upper and lower ends that intersect the breather tube at spaced apart locations along a length of the breather tube to define a valvular conduit.

2. The ESP of claim 1, wherein the undulating contour comprises a U-shaped bend.

3. The ESP of claim 1, wherein the upper end intersects the breather tube at an upper intersection and the lower end intersects the breather tube at a lower intersection that is upper intersection, wherein the portion of the recycle loop proximate to the upper intersection is at an acute angle to a portion of the breather tube adjacent the upper intersection and on a side opposite the uphole end, and wherein the portion of the recycle loop proximate to the lower intersection is at an acute angle to a portion of the breather tube adjacent the lower intersection and on a side opposite the uphole end.

4. The ESP of claim 3, further comprising a multiplicity of recycle loops arranged in series along the length of the breather tube.

5. The ESP of claim 1, further comprising a seal section housing, a guide tube in the seal section that circumscribes a portion of the shaft and that is spaced radially inward from the seal section housing, and a labyrinth chamber defined in an annulus between the guide tube and seal section housing.

6. The ESP of claim 5, wherein the breather tube is disposed in the labyrinth chamber.

7. The ESP of claim 6, wherein a port is formed radially through the guide tube at a location axially between the uphole and downhole ends of the breather tube, so that a pressure communication path between the pump and the motor extends from the uphole end of the breather tube to the downhole end of the breather tube, uphole to the port, and downhole to the motor in an annular space between the shaft and the guide tube.

8. The ESP of claim 1, further comprising a mechanical seal on the shaft and a helical flight on-the-downhole of the mechanical seal, the helical flight configured to increase fluid pressure on a downhole side of the mechanical seal.

9. The ESP of claim 1, wherein the undulating contour comprises a diameter of the breather tube that increases with distance from the uphole end to the downhole end.

10. An electrical submersible pumping system ("ESP") selectively disposed in a wellbore, the ESP comprising:

a motor;

a pump uphole of the motor;

a shaft having an end attached the motor and an opposing end attached to the pump; and a seal section disposed between the motor and the pump having a labyrinth chamber with a flow path that restricts fluid communication, the flow path extending through a breather tube with a diameter that creases with distance downhole.

11. The ESP of claim 10, further comprising a helical flight on an outer surface of the shaft that operates as a positive displacement pump with rotation of the shaft and so that fluid exiting the positive displacement pump generates an increase in pressure on a downhole side of a mechanical seal around the shaft.

12. The ESP of claim 11, wherein the seal section comprises an outer housing with a seal head on an uphole end of the housing, the seal head having an axial bore that receives the shaft, and wherein a vent tube is formed through the seal head that provides a flow path for fluid to flow into the seal section from adjacent the mechanical seal.

13. The ESP of claim 10, wherein the flow path extends through a breather tube with a U-shaped portion.

14. The ESP of claim 10, wherein the fluid flow path extends through a valvular conduit.

15. The ESP of claim 14, wherein fluid flow in a direction to the motor is restricted in the valvular conduit, and wherein fluid flow in a direction away from the motor flows substantially unimpeded through the valvular conduit.

16. A method of operating an electrical submersible pumping system ("ESP") comprising:

providing electricity to the ESP is disposed in a wellbore, to energize a motor in the ESP to rotate a shaft connected between the motor and a pump, so that fluid in the wellbore is pressurized by the pump;

equalizing pressure of dielectric fluid inside the motor with hydrostatic pressure in the wellbore by communicating pressure of the wellbore to the dielectric fluid through a communicating fluid that is flowable along a pathway that intersects a seal disposed between the motor and pump; and blocking fluid in the wellbore from communicating to dielectric fluid inside the motor by diverting a portion of the communicating fluid flowing towards the motor and reintroducing the portion into the pathway in a direction pointing away from the motor.

17. The method of claim 16, wherein the communicating fluid is diverted from the pathway at a first location and reintroduced into the pathway at a second location, wherein the second location is between the first location and the motor.

18. The method of claim 16, wherein the diverted fluid flows along a flow loop, the method further comprising communicating dielectric fluid from the motor along the pathway through the seal, diverting a portion of the dielectric fluid through the flow loop, and reintroducing the diverted dielectric fluid back into the pathway in a direction pointed away from the motor.

* * * * *